United States Patent [19]

Gál

[11] Patent Number: 4,601,089

[45] Date of Patent: Jul. 22, 1986

[54] PROCESS FOR THE MANUFACTURE OF HEAT-EXCHANGER ELEMENTS OF STRIP-FINNED HEAT-EXCHANGERS

[76] Inventor: Pál Gál, 12, Fadrusz u., Budapest XI., Hungary

[21] Appl. No.: 688,261

[22] Filed: Dec. 31, 1984

Related U.S. Application Data

[63] Continuation of Ser. No. 543,802, Oct. 21, 1983, abandoned, which is a continuation of Ser. No. 341,016, Jan. 20, 1982, abandoned, which is a continuation of Ser. No. 135,358, Mar. 31, 1980, abandoned.

[51] Int. Cl.[4] ..... B21D 53/00; B21D 53/02; B23P 15/26

[52] U.S. Cl. ..... 29/157.3 V; 29/157.3 R; 165/170; 228/118; 228/157; 228/183

[58] Field of Search ..... 165/170, 131, 152, 153; 29/157.3 R, 157.3 V, 157.3 D; 228/157, 265, 183, 118

[56] References Cited

U.S. PATENT DOCUMENTS

| | | | |
|---|---|---|---|
| 2,195,259 | 3/1940 | Ramsaur | 165/170 |
| 2,657,018 | 10/1953 | Simpelaar | 165/170 |
| 3,205,560 | 9/1965 | Loehlein | 165/170 X |
| 3,205,563 | 9/1965 | Pauls et al. | 29/157.3 V |
| 3,712,372 | 1/1973 | Tranel | 29/157.3 B X |
| 4,304,821 | 12/1981 | Hayase et al. | 228/157 X |

FOREIGN PATENT DOCUMENTS

| | | | |
|---|---|---|---|
| 705782 | 3/1965 | Canada | 165/170 |
| 665128 | 9/1938 | Fed. Rep. of Germany | 165/152 |
| 1452883 | 11/1971 | Fed. Rep. of Germany | 29/157.3 D |
| 813589 | 5/1959 | United Kingdom | 29/157.3 V |

*Primary Examiner*—Howard N. Goldberg
*Assistant Examiner*—Irene Golabi
*Attorney, Agent, or Firm*—Gabriel P. Katona

[57] ABSTRACT

In a finned heat exchanger, preferably of aluminum, the feed of the fins (1) are secured to tubular passages (3, 3*a*, 3*b*) formed from plates (2) that have been rolled together and then expanded. The bond between the fins (1) and the plates (2) may be an adhesive bond, as by welding or a cohesive bond, as by tight pressing together.

1 Claim, 22 Drawing Figures

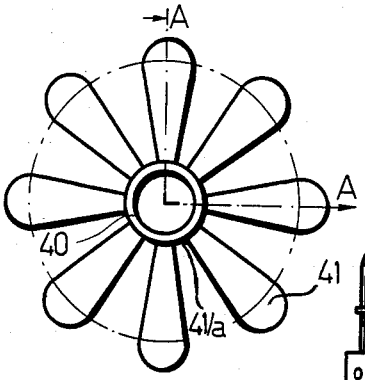
Fig.16
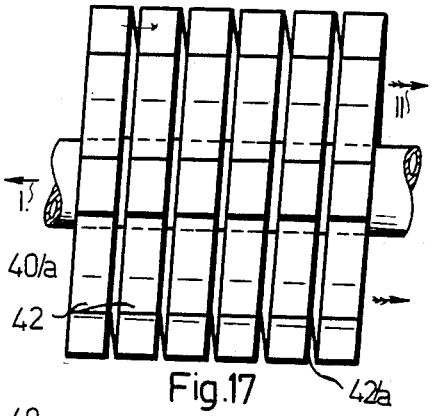
Fig.17
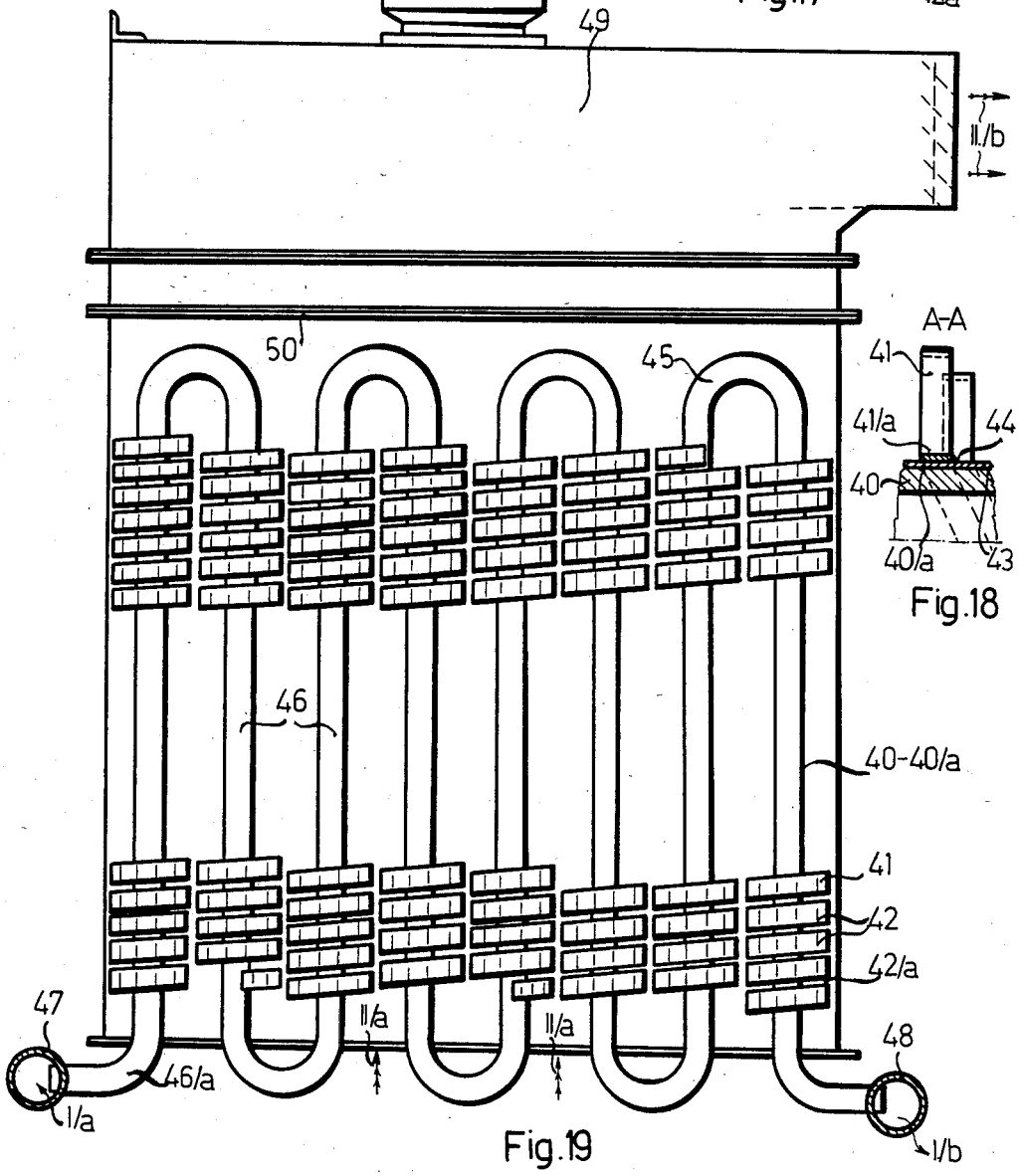
Fig.19
Fig.18

PROCESS FOR THE MANUFACTURE OF HEAT-EXCHANGER ELEMENTS OF STRIP-FINNED HEAT-EXCHANGERS

This is a continuation of application Ser. No. 543,802, of 10-21-83, now abandoned, which is a continuation of application Ser. No. 341,016 of 1-20-82, now abandoned, which is a continuation of application Ser. No. 135, 358, of 3-31-80, now abandoned.

The invention concerns finned heat exhangers the fins of which are made from strip material, as well as a manufacturing process for the elements of such heat exchangers and apparatus for carrying out the process according to the invention.

It is well-known that the manufacture of heat exchangers is made up of several highly labour-intensive phases. In a highly characteristic phase of the manufacturing process parts of circular cross-section have to be made and welded together.

In the known methods of manufacturing heat-exchangers the specific starting material consumption is high and there are several factors which exert an unfavourable influence on this material consumption, such as the nature of the basic material, the thickness of the material of the cooling tubes, the amount of off-cuts when cutting the heat exchanger elements to length, the refuse or off-cuts formed when the cooling fins or platelets are cut or sectioned, and the thickness of the fins and the platelets which are actually thicker than they need to be purely from the point of view of heat transfer, the thickness being dictated entirely by the requirements of the manufacturing technology employed.

It is furthermore known that the various processes for ensuring good metallic contact between the individual constructional elements, such as the welds, adhesive bonds and the so-called "hot dipping" processes, necessitate considerable technological investment in the manufacturing process.

Further difficulties arise in the manufacture of heat exchangers due to the worldwide shortage of coloured and heavy metals and the labour-intensive nature and consequent cost of the process.

Numerous proposals have been made for eliminating or reducing these drawbacks and these proposals display considerable variation and per se valuable development trends. However, no single prior proposal has eliminated all the difficulties outlined above.

Constructions have been proposed wherein the cooling fins or platelets have a special configuration but in general this has merely made the manufacture more complicated and required significant manual labour intervention. Consequently, such constructions have been restricted to narrow and specialised areas.

British Pat. No. 1,242,397 proposes a motor vehicle internal-combustion engine radiator in which the heat-exchanging fluid ducts are partially defined by bent aluminium foil adhesively bonded to other metallic parts by a heat-curable or vulcanisable adhesive. However, it is a considerable problem with this proposal that the use of a significant amount of synthetic material in effect represents a significant amount of heat-insulating material thus forming heat dams in the path of heat flow.

Bearing in mind that the main application of this proposal is for a motor vehicle radiator core, then if one were to attempt to construct the proposed device without a heat-curable adhesive, the bent fins would come into vibration during operation, would be displaced from their rest position and would wear out the surface they are in contact with by friction. Moreover, this proposed construction is in principle incorrect in that it proposes a lengthy and flat liquid flow path which unfavourably influences the heat transfer coefficient and operational reliability. The number of bonds on the metal surfaces must be restricted for economy because for the bonds to be good technological prerequisites, e.g. the cleanliness of the metallic surface, have to be satisfied. Accordingly, the proposed welds and bonds cannot in the present state of art be applied industrially in a satisfactory manner. Moreover, this construction proposes aluminium plates of a thickness less than 0.3 mm and of an intricate surface shape and such surfaces cannot be industrially secured together in large series in an economic and reliable manner, not even with the proposed electron beam or plasma arc-welding, even if one were to disregard the expense and low efficiency of such methods. Moreover, a further disadvantage of this construction is that the heat-exchangers are essentially only usable for one purpose, namely a radiator core for a motor vehicle.

Other known proposals include e.g. Hungarian Pat. No. 161,650 wherein it is proposed to solder locally the "skirt" of aluminium fins or platelets to the outer surfaces of tubes. However, because of the large amount of manual labour involved, such heat-exchangers can only be manufactured where the fin or platelet thickness reaches a certain minimum value and of course it also suffers from the well-known disadvantages due to soldering alloys.

Another known construction for achieving good metallic contact between the tube and the fin or platelet involves rolling zinc powder into the aluminium surface whereby the zinc-coated surface becomes solderable. A disadvantage of this proposal is that one surface of the aluminium fin must be fully coated with zinc in a thickness which enables it to be soldered without burning through the layer. Such a layer requires a thickness of the order of 1/10 mm which thickness however would otherwise in itself be enough for the material of the fin. In this way, a double thickness fin results which is a very expensive solution to the problem.

Hungarian published application No. CA-329, entitled "Finned Heat-Exchangers" discloses a construction which is light in weight and utilises relatively little constructional material while seeking to achieve good technical parameters. Its disadvantage is that it is essentially suitable only for effecting heat exchange between two materials of identical character and does not solve a reliable and suitable separation between the two media. Moreover, it is not pressure-resistant and does not solve the problem of manufacturing the fins in a way best suited from the point of view of flow technology. Because of the good heat and anti-corrosion properties of aluminium, this material is virtually exclusively used by research and development engineers in spite of the above-indicated difficulties. The technologists have attempted to overcome these difficulties partly by new geometrical configurations for the heat-exchanger elements. These attempts have given rise to various processes for manufacturing helical fin tubes, such as for instance in Hungarian Pat. Nos. 166,214 or 157,652. Because of its favourable heat-technological properties and versatility, helical fin tubes are highly favoured in heat-exchanger technology but the difficulties of large material requirements and labour intensive manufacturing also arise with such helical fin tubes.

West German Pat. No. 2060878 discloses a process of manufacturing fin tubes wherein micro-plates applied to the cylindrical tube are transformed into helical fins.

The proposed construction is clever but uneconomical for the manufacture of helical fin tubes because the final product is achieved in a rather complicated way, more complicated than can be achieved at greater productivity with other known methods and with fewer tools. Although the apparatus proposed can be used for applying the plates or fins to the outer surface of the tube the fins are still not fastened sufficiently securely in the absence of a really satisfactory technology for mechanical binding or welding or soldering.

The above-mentioned specification mentions only as a desideratum that the plates are fixed to the outer surface of the tube. Furthermore, it is known from U.S. Pat. No. 3,745,631, that heat-exchanger elements may also be manufactured by a method wherein pretreated e.g. pre-tinned flat copper tubes are welded together with preshaped, bent copper fins.

This last-mentioned solution can only be used efficiently with a narrow choice of materials and a narrow area of application. Besides, even within the narrow area of application, e.g. a radiator core for a motor vehicle, the proposed solution does not represent a complete break with traditional and generally widely used technologies according to which the tube ends are welded in the water chamber one by one. This represents extra expenses and the danger or risk of faults occurring is comparatively large.

A process is known from U.S. Pat. No. 3,855,682 for soldering together an aluminium part and a ferrous metal or cuprous metal part wherein aluminium fins or plates are soldered to copper or steel tubes with the aid of chemical reduction of a metal fluoborate contained in an organic flux.

However, when soldering is used, independently of the actual technological process, in everycase an oxide layer is removed from the surface to which then an alloy composition containing heavy metals is applied. The heavy metal compositions form a galvanic unit or element with the aluminium accompanied by the injured oxide layer which has been rendered discontinuous. In this way, the phenomenon of electrolytic corrosion arises with soldered bonds. In electrolytic corrosion phenomena, in accordance with the electric normal potential, always the more electro-negative metal passes into the solution. In this way, since aluminium and its alloys are more electro-negative than the heavy metal, then it is always the alloy that passes into solution. This phenomenon is a function of the nature of the metal being used but in all cases the phenomenon takes place rather rapidly because no matter what alloy type is being employed in every case a voltage difference of more than one volt is formed across the surfaces in question. The relatively high voltage difference gives rise to gaps, crystal faults and other corrosion damage and as a consequence up till now, not a single soldered aluminium heat exchanger has passed into general industrial use.

East German Pat. No. 114,986 is concerned with a very individualistically shaped heat exchanger construction. The heat-exchanger is made from tubular plates wherein there are two parallel tubes respectively designated dividing or distributing and collecting tubes, and perpendicularly to these tubes parallel liquid flow paths are formed. The tubular plates rolled and pressed in this way are associated with flat surfaces between the tubular parts which are then cut and bent out of the plane of the connection between two like tubular portions. The thus-obtained configuration can be used singly or multiply to obtain a transverse flow heat-exchanger. Between the parallel coolant paths turned out of the set plane, fins may be provided to improve the heat transfer. On realising a heat-exchanger according to the aforesaid East German patent specification, the bent out tubular passages become rather widely spaced from each other for heat exchangers. In effect, what is formed in this way is a radiator-like configuration the heat-exchanging surface area per volume of which is really rather low. Such a construction cannot therefore be economic for forced flow heat-exchangers because the air flows through freely and unimpeded through the large gaps between the individual elements.

An aim of the present invention is to reduce or eliminate the disadvantages of the above-described processes and constructions and to provide strip-finned heat exchangers as well as a suitable process and apparatus for their manufacture wherein a large variety of heat exchanging elements can be manufactured with relatively low material consumption in a process which is automatic or semi-automatic and which therefore requires relatively little manual labour.

Another aim of the invention is to provide a heat-exchanger wherein the cooling tubes can be connected to each other and to other connecting elements in a leak-proof and mechanically solid and rigid manner.

These aims are sought to be satisfied or achieved according to the present invention in a finned heat exchanger wherein the foot portions of the fins are secured to the tubes or plates provided with a tubular throughflow section by means of a permanent, i.e. unreleasable bond wherein the tubular sections may be formed from plates rolled onto each other and which is essentially characterised in that the contact surfaces, that is to say the outer face of each fin is connected to a flat face of the plate by a cohesive and/or adhesive bond.

In one preferred embodiment of the heat-exchanger according to the invention the outer surface of the tube has fins threadedly secured thereto, the fins being arranged in a star configuration at suitable spacing along the length of the active tubular sections of the heat-exchanger, in such a way that between the tubular surface and the foot of the fin there is a cohesive fastening or bond.

According to another aspect of the invention there is provided a process wherein the tubular elements of the heat-exchanger are formed by rolling plates onto each other and the drawings or plans of the heat contact coupling are formed on the surfaces of the plates by a photochemical process whereafter the tubular passages are brought about by hot-rolling and expanding e.g. pneumatically or hydraulically.

In the course of carrying out the process the heat-exchanger elements are assembled and retained in a frame and the tubular passages are expanded by test-pressings or a separately performed pressing and the directly heat-transmitting surfaces are brought into close adhesive connection.

Simultaneously with the bending of the strip fins and/or the star strip fins, cohesive bonds are formed with the tubular passages and the surface portions of the tubes.

The apparatus serving to carry out the process is characterised in that it has orienting and carrying rollers which clamp a disc between them, the disc being provided with bending arms, and a shaft of a rod extends between the bending arms of the disc which rod is in a radial conduit wherein it can be displaced and finally means are provided for rotating and advancing the mechanism.

The rod is formed as a bending and welding rod or electrode while it may be formed also as a bending and plating rod.

The invention breaks with hitherto known technologies and enables the manufacture of strip finned heat exchanging elements in a completely novel manner by connecting the strip fins with the cooling tubes or cooling passages by a direct adhesive or cohesive bond.

The fundamental process of the manufacture of the heat exchanger is that the cooling tubes should be connected to each other and/or to the walls of tubes in a leak-proof and satisfactorily mechanically rigid manner. Hitherto this phase has been largely effected by manual labour. Thus, this process requires highly qualified and skilled operators and is also vey highly energy-consuming. Because of the known technological difficulties, such solutions have only rarely been employed when aluminium is the constructional material. The significantly more expensive copper tubes have been used in preference because of these difficulties.

The present invention obviates the hitherto known technologies and is based on the discovery that two plates can be formed with cavities to supplant rows of tubes by taking one of the plates and producing a diagram thereon corresponding to the coolant flow passages which may be as desired, the diagram being formed by e.g. a chemical process, then the other plate is placed on the diagram and the two plates are rolled together, and plated, and then expanded in a template or pattern and in this way in effect a row of tubes is obtained. According to a further preferred embodiment the tubes are manufactured by continuous drawing to produce tubes of the appropriate and desired lengths and then by appropriately bending these tubes a weld-free row of tubes is obtained.

Thus the technology according to the invention breaks with the cyclic or intermittent fin production and the individual finning of the tubes which have hitherto been the main obstacles to improving productivity. In the invention, the feet of the strip fins are continuously cohesively bonded to the plates or tubes simultaneously and in one step with the bending of the strip fins and moreover as desired this can take place simultaneously in several rows and symmetrically on both sides of the plate.

It is furthermore a preferred feature of the invention that the use of soldering or welding material is completely obviated when connecting the fins with the tubes because the cohesive bond between the two components is effected by welding their own material together simultaneously with the shaping or forming process.

The discovery that the application of the fins can take place simultaneously, as a function of the construction, in several rows next or opposite to each other, can provide a very great increase in productivity.

The forming and welding apparatus may be formed in such a way that in accordance with the requirements of the construction the width and thickness of the strips and the length or height of the strip fins and their spacing may be varied. In this way, the heat exchanging element that can be manufactured with the same apparatus may vary within wide limits in dependence upon the area of application.

The invention is described, merely by way of example, with reference to the accompanying drawings, schematically illustrating the invention and wherein.

Figure 11:
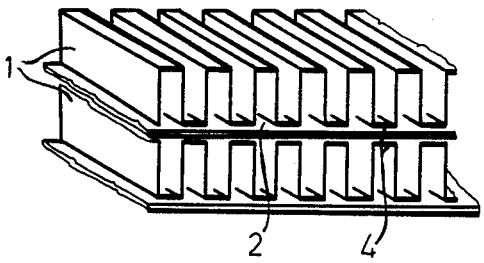
FIG. 11 is a view similar to FIG. 10 but showing the product for making a recuperative heat-exchanger when it is provided with fins and spacing plates on both sides thereof.
Figure 12:
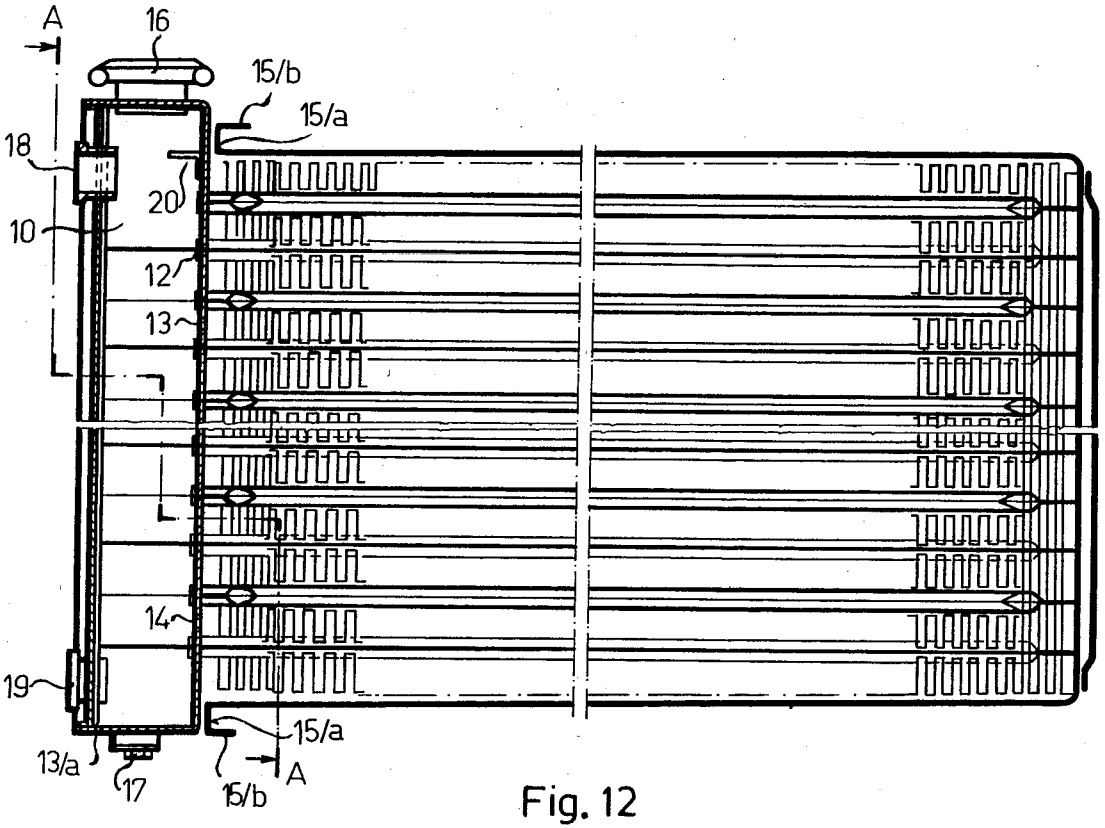
Figure 11A:
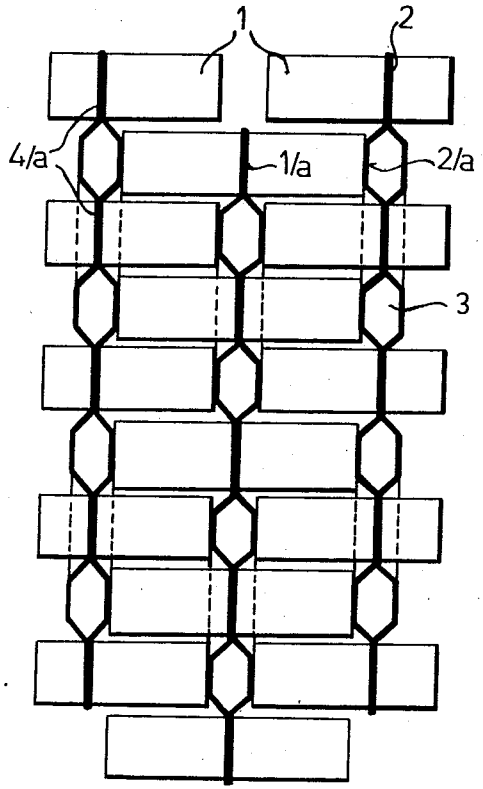
Figure 14:
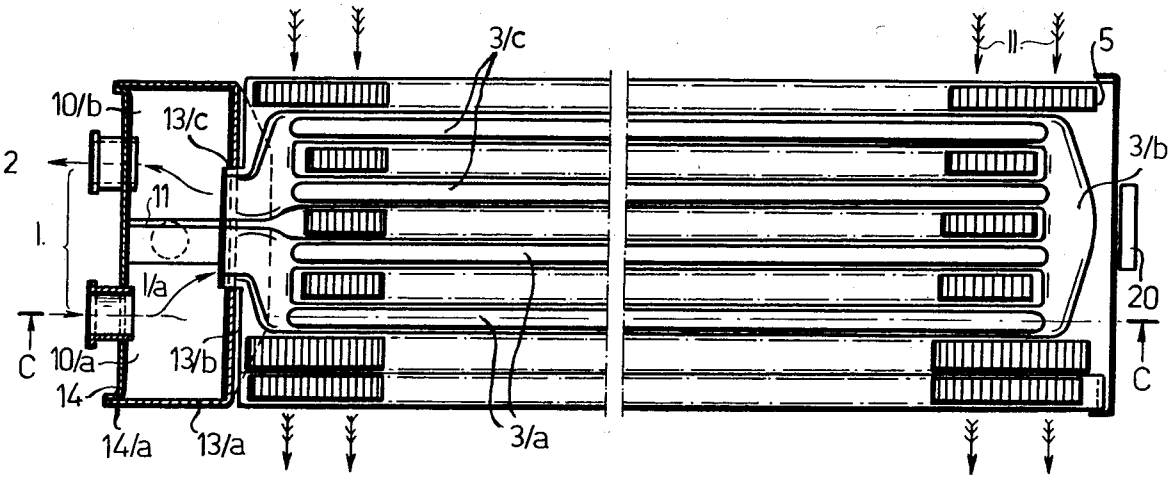
Figure 13:
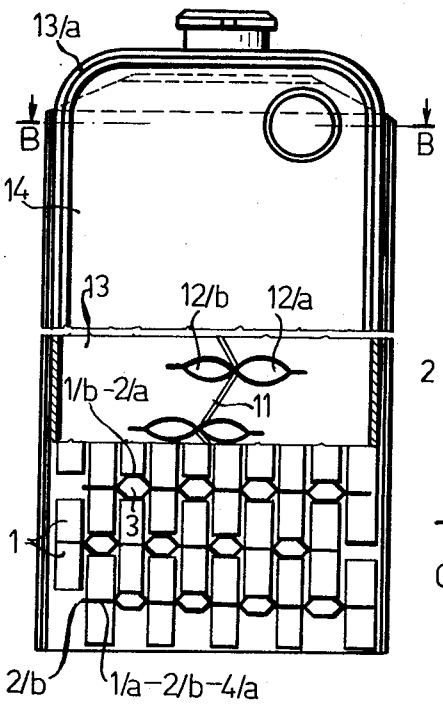
Figure 15:
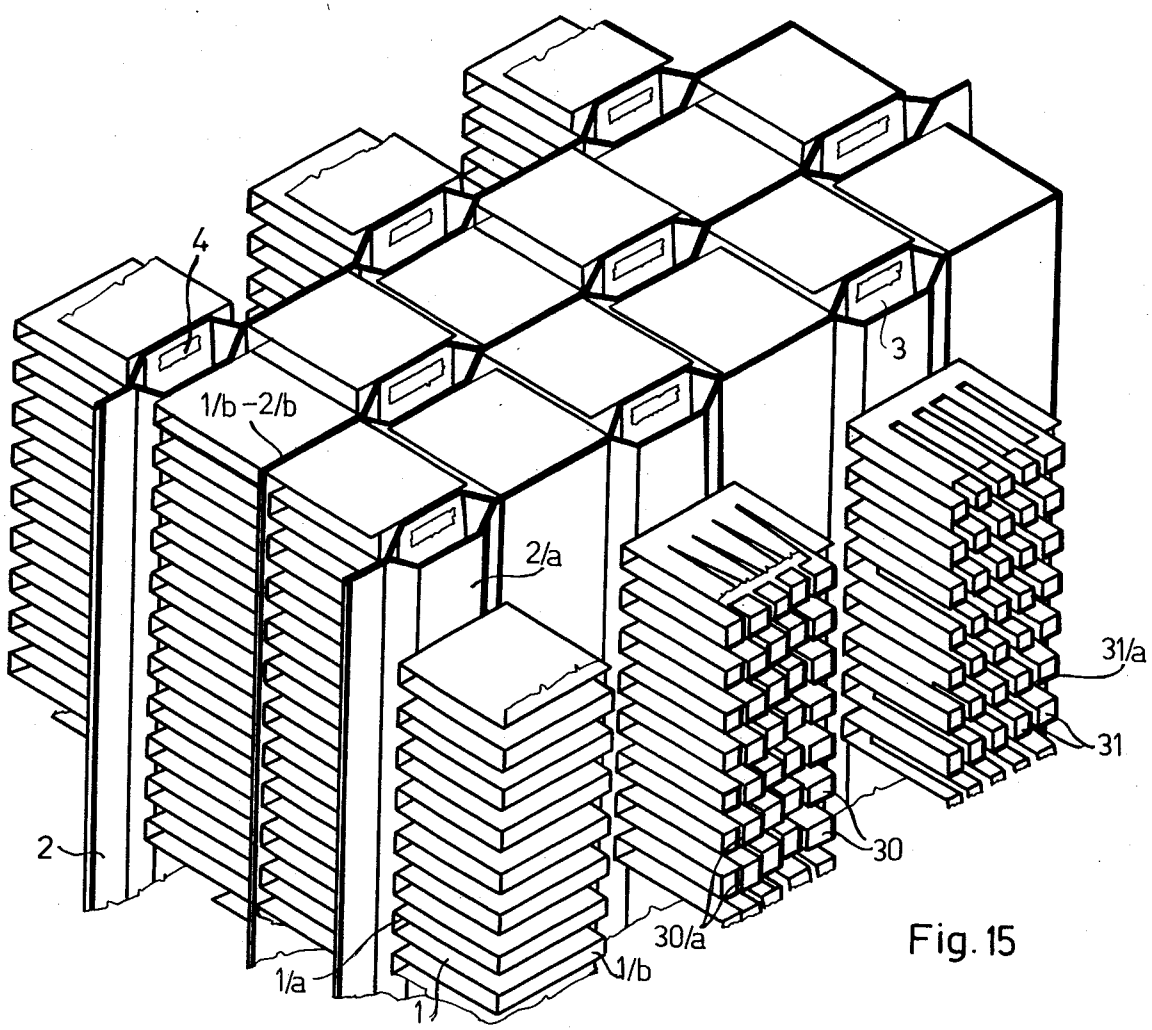
Figure 21:
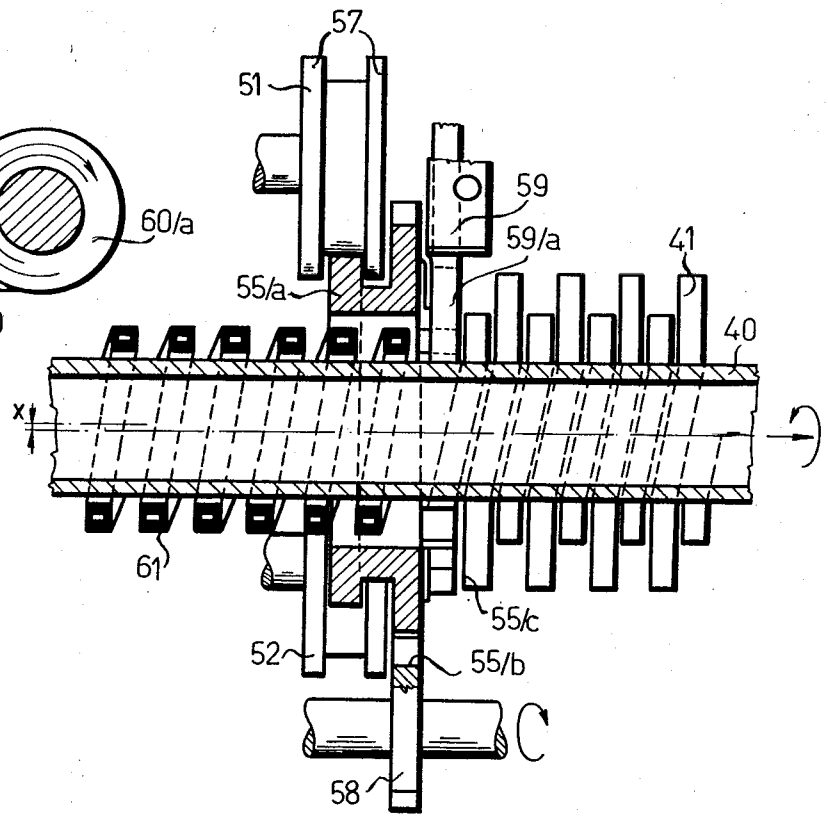
Figure 20:
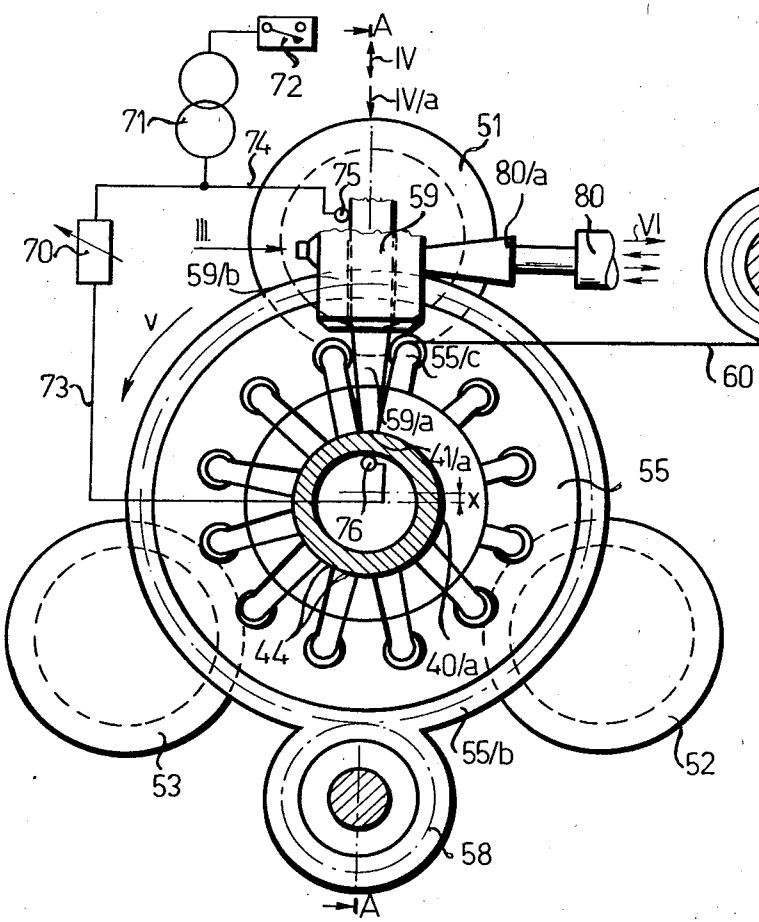

FIG. 11*a* is a schematic view of a heat exchanger with offset tubular passages;

FIG. 12 is a section of a motor vehicle radiator core having twin chambers and a plurality of flat rows of tubes;

FIG. 13 is a sectional view taken along the stepped cross-sectional line A—A of FIG. 12;

FIG. 14 is a cross-section of the motor vehicle radiator core shown in FIG. 13, taken along the line B—B;

FIG. 15 is a perspective view of a condenser or a portion of a water-cooler;

FIG. 16 is a front elevation of a tube provided with fins in a star configuration;

FIG. 17 is a side view of the tube shown in FIG. 16;

FIG. 18 is a cross-section of the tube taken along the planes indicated by A—A in FIG. 16;

FIG. 19 is a diagrammatic elevation of an industrial air-cooler provided with star fins;

FIG. 20 is a diagrammatic scheme for apparatus for manufacturing a serial star-finned tube; and FIG. 21 is a cross-section of the apparatus shown in FIG. 20, taken along the line A—A.

Figure 1:
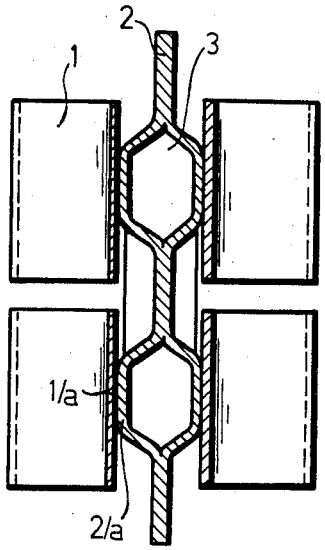
FIG. 1 is a cross-sectional view of a portion of a heat-exchanger formed from expanded plates formed with tubular passages, with strip fins connected to flat faces of the tubular passages.

Referring to FIG. 1, there is shown a fragmentary heat exchanger wherein the tubular passages 3 are formed from plates which have been welded together and plated and wherein the strip shaped fins 1 are fixed thereto by securing together a flat side 2*a* of the tubular passage 3 and the outer face 1*a* of the strip fins 1.

Figure 2:
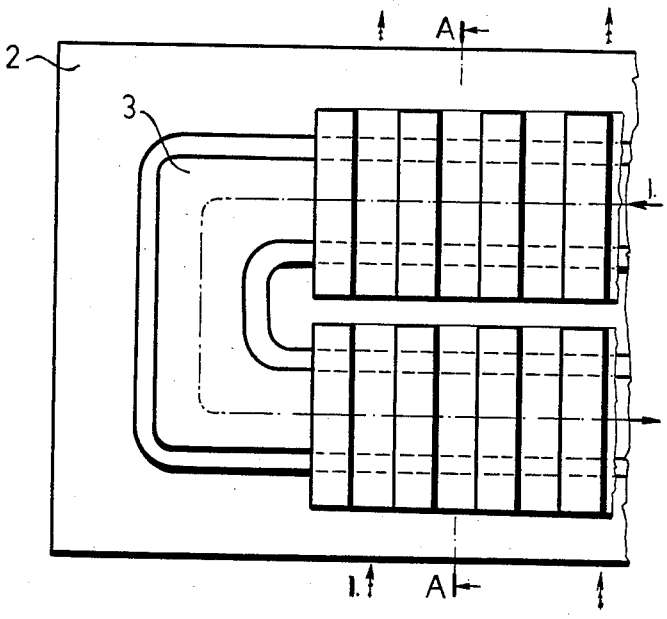
FIG. 2 is an elevation of the heat-exchanger shown in FIG. 1.

FIG. 2 illustrates by an arrow I the direction of flow of the heating or cooling medium while the arrow designated by II indicates the direction of flow of air.

Figure 3:
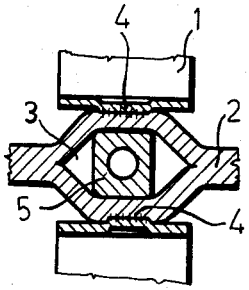
FIG. 3 is a sectional view of the heat exchanger provided with strip-like fins in the course of manufacture thereof.

In forming the tubular passages 3 it is expedient to place one of the welding electrodes 5 which is provided with a water channel and which is therefore water-cooled, inside the full length of the tubular passage 3. The welding electrode 5 then not only serves to weld the fins 1 to the tubular passages 3 but also serves to ensure that the tubular passage should not collapse during the formation and welding of the strip-like fins. When the tubular passage has been equipped with the strip fins, then at the end of that procedure the electrode 5 may be removed. FIG. 3 shows the welding seam 4 at the foot of the fin 1. This particular solution can only be used for U-shaped tubular passages.

Figure 4:
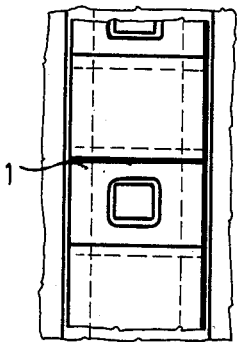
FIG. 4 is a plan view of the portion of the heat exchanger shown in FIG. 3.

The plan view of FIG. 4 does not show the welding electrode itself but shows the trace it leaves on the fin 1. When the pitch or spacing of the fins is greater then the welding to be employed must have a different geometry to ensure greater metallic contact areas.

Figure 5:
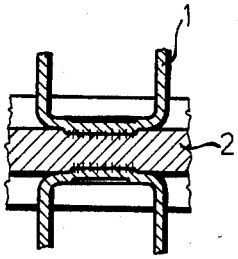
FIG. 5 is a cross-section illustrating thin strip-like fins placed between the cooling passages.
Figure 7:
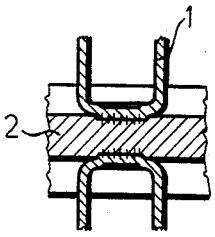
FIG. 7 is a cross-section of a portion of a strip finned heat-exchanger having a narrower or smaller fin spacing.
Figure 6:
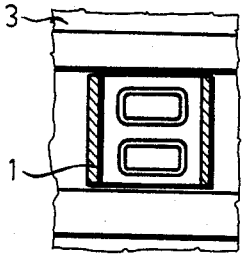
FIG. 6 is a part-sectional and part-elevational view of the heat exchanger fragment shown in FIG. 5.
Figure 8:
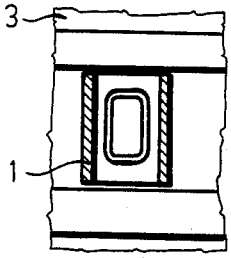
FIG. 8 is a part-sectional, part-elevational view of the heat-exchanger shown in FIG. 7, and taken at right-angles thereto.

The cross-section of FIG. 5 shows an embodiment wherein thin strip-fins 1 are connected to the surface of the plate 2 at several locations. The connection or fastening between the fins and the plates may according to FIG. 6 be effected by ultra-sonic welding or, as shown in FIG. 7, where the material of the strip fins is thicker, and the pitch or spacing of the fins is smaller, by spot welding. This is also shown in FIG. 8.

Figure 9:
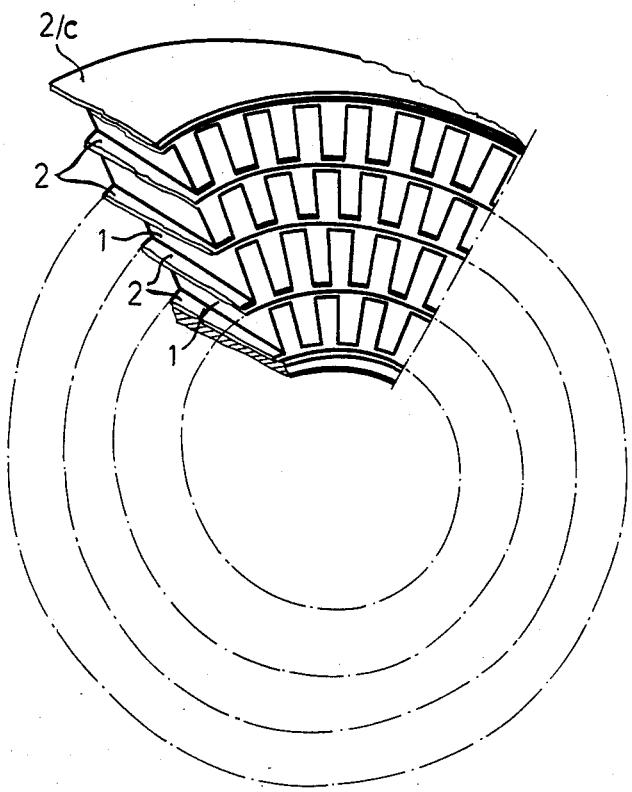
FIG. 9 is a fragmentary perspective view of a portion of a recuperative heat exchanger, having a rotary hub, and having strip fins applied or wound in an Archimedean spiral.

FIG. 9 shows a part of a recuperative heat exchanger. This heat-exchanger is provided with strip-like fins welded on the plate 2 which has been formed into an Archimedean spiral shape.

In this case, the material of the strip fins 1 is not produced by separating the plated sheets but instead by a previous plate bending process, expediently by bending the edges of the plates.

Figure 10:
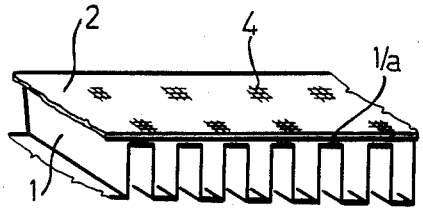
FIG. 10 is a view developed into a plane of the finned plate required for realising a recuperative heat-exchanger according to FIG. 9.

As may be seen from FIG. 10, the plates 1 bent in the above-described manner and carrying the fins 1 are spot welded at their outer faces 1*a* to plates 2 the weld seams being indicated at 4.

The same result can also be achieved by providing both sides of the plate 2 with fins 1, as shown in FIG. 11.

FIG. 11*a* shows a forced-flow heat-exchanger portion wherein the strip fins 1, the welded and plated sheets 2 and tubular passages 3 are connected in series and in parallel in accordance with the well-known criteria of heat-transfer technology.

The outer faces 1*a* of the strip fins 1 are welded at locations 4*a* to plates disposed at the edges of tubular passages and between such passages. In this way, the plurality of fin rows welded to the plate 2 form a finned heat exchanger element. Several completed heat exchanger elements may be assembled together by offsetting one of the rows with the aid of the strip fins and placing it on the adjacent row while the third row is aligned with the first row of such elements. From the point of view of manufacturing technology, it is expedient to form one inlet and one outlet. In this way, each individual heat-exchanging element in effect forms a closed system with only a minimal risk of faults and leaks.

In another expedient embodiment, the heat exchanger elements to be assembled together are of one piece. The diagram or plan of the individual or tubular passages of the heat exchangers together with their connecting ducts, are continuously applied to the plates 2, with a suitable offset, and then after rolling, expanding and finning, the individual heat-exchangers are bent forwards and backwards and laid upon each. The heat-exchanger formed in this way is thereafter processed or handled as described above. The figure does not show the inlets and outlets which can be formed in any suitable manner by welding a cylindrical tube into the tubular passages 3. Another expedient solution may lie in welding in the outlet opening of the tubular passages, which are of course absolutely necessary for the expansion process and by resistance welding or inductance welding connecting eyes are welded at the appropriate locations of the tubular passages of the sheet 2. These eyes are then suitable for making further connections. This solution is particularly advantageous where the sheet 2 is made from aluminium.

After welding the tubular connections, the covered heat-exchanger held in a frame is subjected to pressure tests. The pressure test is of course a compulsory matter for all heat-exchangers. However, in the heat-exchanger according to the invention, the pressure test is not only a safety and reliability check but at the same time also forms the final or finishing technological phase of the assembly. When the covered and framed tubular elements are subjected to suitable pressure, then the tubular passages inevitably undergo a certain deformation and extension in the direction of the strip fins. This extension is sufficient to ensure that due to any manufacturing or assembling inaccuracies, any loose heat-exchanging elements should be tensioned or come into tight engagement with a frame or with each other. In this way it can be ensured that the flat faces 2*a* of the tubular passages 3 should tightly engage the outer faces 1*a* of the strip fins 1 whereby to form a metallic contact therebetween which is suitable for good metallic heat transfer.

FIGS. 12, 13 and 14 illustrate a heat-exchanger in the form of a motor vehicle radiator core. The principle of construction of the strip fins 1 and the tubular passages 3, that is to say the basic characteristic of the heat-exchanger elements, is identical with the heat exchangers shown in the above-described embodiments, although of course the constructional configuration and the heat flow connections are different. The water chamber of the radiator core in the illustrated embodiment is of the twin-chamber type. A double layer baffle plate 11 separates the hot water chamber 10*a* from the cooled or cold water chamber 10*b*. Each individual cooling element 6 is connected by way of a tubular neck 12 to the water chamber 10 whereby to form a double passage 12*a* and 12*b*. The water to be cooled flows through passage 12*a* into the cooling element 6. It then flows through the two tubular passages 3*a*, turns as it flows through tubular passage 3*b*, flows back through the cooling passages 3*c* and, having cooled down, discharges through the passage 12*b* into the cooled or cold water chamber 10*b*.

The mutually superposed cooling elements 6 are connected in parallel in accordance with the foregoing flow scheme.

The motor vehicle radiator describes in the preceding paragraphs differs from hitherto known constructions. The new construction has numerous advantages, for instance it is not necessary to solder a large number of pipes to the tube wall. With conventional motor vehicle radiators each tube is associated with two soldering operations for soldering into the tubular wall, while in the present invention one tube wall connection is associated with four tubular passages.

The tube wall 13 is expediently produced by deep-drawing, so that it should be unitary with the sides of the water chamber 13*a*. In this way a very simple water chamber configuration can be achieved because its one open side may be closed simply by a rimmed cover 14 which bears against the sides 13*a* of the water chamber and is matched thereto. The cooling elements 5 are superposed in the distribution according to the drawing and are placed in the frame 15. The connection openings 13*c* of the tubular wall 13 are aligned with the tube necks 12 onto which an assembly the tube walls 13 are fitted.

The tube wall 13 is fixed to the shoulders 15*b* of the frame 15*a* by spot-welding or line-welding. The tube necks 12 are connected in a leakproof manner e.g. by brazing or by another expediently chosen method of welding, to the tube wall 13. In the case where one utilises plate materials which are so thin that a high quality weld cannot be used at all, then it is expedient to use fusion adhesive bonding. This insulation is of neutral effect on heat transfer because it is in contact with only one side of the water chamber. The cooling at the air-side of the adhesive material disposed between the tube neck 12 and the opening 13*c* is also ensured because the air stream is at all times in contact with the surface 13*b*. In the figure arrows I indicate the path of the coolant water while the arrows II indicate the direction of flow of the cooling air.

FIG. 15 illustrates a complex industrial condenser or water cooler. The strip fins 1 are disposed on the tubular passages 3 in agreement with the embodiment already shown in FIGS. 1 and 2 above but its plate 2 has more tubular passages 3. The drawing does not show the end construction of the cooling elements 6 which may at one end be e.g. open with the tubular passages 3 coupled into the tubular wall while at its other element, it may e.g. be flattened and open as for instance is shown in FIGS. 12, 13, and 14 with regard to the tubular neck 12 of the motor vehicle radiator. In the present illustrated embodiment, there is shown a slit fin 30 wherein before bending and welding a cutter cuts the strip at several places intermittently to produce openings or slits 30*a*. Another manner of construction is shown by the cut-away strip fin 31. Here, before bending and welding, appropriately sized strips are cut intermittently at several locations from the basic strip, to produce openings 31*a*. The slit strip-fin 30 and the cut-away strip fin 31 represent embodiments which for certain heat exchanges can produce a greater air-side heat transfer. It is an advantage of this embodiment that the transmission tool can be operated synchronously with the fin forming apparatus so that this part operation does not require a separate working phase. The embodiment shown in FIG. 15 makes it possible to manufacture in a particularly simple manner the very large air coolers used in power stations, in the chemical industry etc. because the elements may be made in accordance with the technical requirements in any arbitrary length and width and can be finished to the required size.

FIGS. 16 and 17 illustrate a further advantageous embodiment of the present invention wherein the fins are in a star-formation around the tube. As shown in these Figures, a tube 40 is provided with a star-shaped strip-fin formation 41 helically applied thereto with a pitch 42 and with a gap 42*a* between adjacent "threads" or turns. The bottom portions or feet of the star fins are designated by 41*a* and they connect with the outer surface 40*a* of the tube 40. The height and axial and radial spacing of the fins 41 may be varied in accordance with actual need. It is an advantage to arrange the fins in a star-shaped configuration that in this way one can obtain purely parallel or counterflow heat exchange. It is a further advantage that should operational conditions, e.g. frosting, require a larger fin spacing, then the fin surface area per unit tube length can be increased by increasing the height of the fins. Its further advantage is that the cylindrical tube can be continuously or intermittently finned with the star-configuration fins.

In certain areas of application, the use of a cylindrical tube may become an operational criterion under certain conditions. This embodiment satisfies this requirement. The arrow I indicates the direction of flow of the coolant medium, while arrow II indicates the flow of air.

FIG. 18 is a cross-sectional view of a further detail of the tube shown in FIGS. 16 and 17 and provided with fins in a star configuration. FIG. 18 shows a combined or composite manner of assembly: 40 is a drawn steel tube provided by hot-dipping with a metallic coating 43, which is expediently aluminium. The metallic coating layer 43 protects the steel tube 40 against corrosion as well as forms the outer surface 40*a* thereof. The bottom or foot 41*a* of the star fin 41 is fixed to the surface 40*a* by a welded seam 44.

FIG. 19 is a half-elevation of an ammonia cooler wherein strip fins 41 are applied in a star configuration and with a "pitch" 42 by welding on the outer surface 40*a* of a tube 40, with thin gaps 42*a*. The star strip-fins 41 are welded to the tube 40 with a spacing appropriate to the length of the cooling element. In the manufacturing stage the tubes are straight but after being provided with fins, the finned tubes are bent according to arcs 45 into a sinuous tube to provide one element of the cooling unit. The cooling element 46 is connected to a distributor pipe 47 by way of a tube stub 46*a* while it is connected to a collecting manifold 48 by way of a tube stub 46*b*. The cooling elements 46 are disposed in a mutually superposed and offset configuration but the Figure shows one row only, and in this way they form a complete heat-exchanger battery. A ventilation or blower housing 49 is connected to a coolant cover 50. The cooling liquid enters the cooler at arrow I*a* and is discharged therefrom along I*b*. The arrow II*a* indicates the direction of flow of the air entering the cooler while arrow II*b* indicates the direction of the exiting air.

The above described and illustrated heat exchangers are all manufactured by a technology based on the same inventive concept. Since they are the same, only one fabrication apparatus will be described in FIGS. 20 and 21 which schematically shows the manufacturing process and apparatus for making fin tubes with a star-shaped fin configuration. The apparatus illustrated is suitable for making in a single working phase the star-shaped fin configuration 41 and to perform the welding or plating, or possibly soldering, simultaneously with the fin manufacture to secure the fins 41 and the tube 40 together. The illustrated apparatus is capable of manufacturing steel pipe and steel star fins and also a steel pipe provided with an aluminised surface by a hot-dipping method, to which then aluminium fins are secured. However, the apparatus may also be used with other constructional materials in an efficient manner.

FIG. 20 shows the manufacturing and welding-plating apparatus in front elevation.

FIG. 21 shows the same apparatus but in cross-section, in the plane of symmetry of the tube. Orienting and carrying rollers 51, 52 and 53 are equiangularly disposed at 120° spacing around a circle. They hold or clamp a disc 55 provided with bending arms. The rim portion 55*a* of the disc 55 is in engagement with shoulders 57 of the said rollers in such a way that relative rolling motion on the cylindrical surfaces should be easy. Bending arms 55*c* are disposed at a suitable angular spacing on the side surface of the disc 55. The outer diameter of the disc 55 is provided with a so-called "toothed gear" formation 55*b* which meshes with a driving toothed gear wheel 58. The bending and welding or plating head 59 is capable of performing vertical reciprocating movement in the arrangement according to the Figure and is synchronously controlled or guided with intermittent angular displacements of the bending disc 55.

The bending and welding head 59 is made up of two parts: a housing 59*b* which is connected to the driving mechanism and which can be cooled and, on the other hand, from a bending welding or plating, rod-like element 59*a* which is made from copper or steel depending on the intended use and operational considerations. The strip material 60 is fed into the apparatus from a stock roll or disc 60*a*.

FIG. 21*a* illustrates a tube heater 61 which is required when it is desired to weld or plate thin star strip fins to a thick-walled tube. The arrow III designates the flow of coolant that can be supplied for the head 59. FIGS. 20 and 21 illustrate the core tube 40 and the fins 41 of star-shaped configuration.

FIG. 20 also shows the schematic electrical circuit diagram of the spot-welding machine associated with the manufacture of the star-finned tubes.

The apparatus illustrated and described so far may operate in two different expedient modes within the possibilities provided by the invention:

First mode of operation: the rollers 51, 52 and 53 guide the disc 55 provided with the bending arms in such a manner that the disc 55 should have an eccentricity X towards the bending and welding head 59, measured from the centreline of the tube. This is required so that the angularly displaced bending arms 55*c* should be readily displaceable, and removable from between the star fins 41 in an axial direction when during rotation they reach a position of smaller diameter. The disc 55 is driven by means of the ring of teeth 55*b* from the driving gear 58.

Rotation of the disc 55 is intermittent and in each indexing movement the angular displacement of the disc 55 is such that the bisection line of the angle included with a given bending arm 55*c* should coincide with the line of action of the bending-welding head 59. In this position of the disc 55, control means not shown in the drawing press the head 59 downwardly in the direction indicated by arrow IV so that the rod 59*b* should come to a stop on the outer surface of the tube 40. During this time the strip 60 is drawn in and bent in accordance with the desired dimensions of both fins 41. The foot 41*a* of each fin is pressed with great force against the outer surface of the core tube 40 which has been heated by the heater 61 and thus a welded or plated connection comes about. Then, the head 59 is retracted in the direction of arrow 4 and then the disc 55 with its bending arms indexes in the direction of arrow V by another unitary angular displacement and the above-described manufacturing steps are repeated cyclically.

In the illustrated operating system, there are arrows not referenced at the right-hand side (as viewed) of FIG. 21 and these arrows illustrate the intermittent rotational and advancing movement of the tube to result in the desired star fin configuration of suitable pitch and spacing.

A further development of this mode of operation constitutes the second mode of operation wherein the head 59 moves along the direction of arrow IV*a*, that is to say the fin foot 41*a* is pressed against the outer surface of the tube 40. At this point, an electric spot-welding apparatus is brought into operation, the apparatus comprising contact terminals 75 and 76, a regulator 70, a transformer 71, a switch 72 and leads 73 and 74. The spot welding apparatus serves to weld the feet 41*a* of the fins to the outer surface 40*a* of the tube. The thus obtained spot-welding 44 provides reliable connections and gives good heat transfer between the tube 40 and the fins 41.

In a highly expedient embodiment, the above-described two processes may be combined by means of the use of an ultrasonic generator 80 which brings the head 59 into vibration with the aid of the rod 80*a* along the direction of the arrows VI. The high-frequency vibration promotes the welding of the connected parts and thus the apparatus may be operated with a lower electric and head load. The combined ultrasonic welding may with particular advantage be employed in the formation of thin aluminium strip fins and thin-walled tubular passages in which case the preheater 61 may even be omitted.

The apparatus and method for manufacturing strip finned heat-exchangers according to the invention and such heat-exchangers have the followiwng principal advantages:

The heat-exchangers require relatively little material, are of low weight and have a high specific heat output and efficiency.

The heat-exchangers are highly versatile: this is true both for the cold and the hot side of each energetic system.

The invention enables the use of high pressure and thus high-temperature motor vehicle cooling, in contrast to the hitherto known motor vehicle radiators, and this in turn gives rise to several improved or enhanced effects e.g. in the fields of manufacture and operation of motor vehicles:

(a) because of the higher temperature the radiator may have a smaller cooling surface area, its weight may be reduced and its costs can be reduced also, (b) the thermal efficiency of the engine becomes more favourable which represents a significant and favourable change in the fuel consumption.

The process provides a solution which enables aluminium to be used as constructional material in a very wide area of application in the manufacture of heat exchangers because it eliminates the significant technological difficulties, as experienced hitherto, in the course of welding and soldering this metal. Moreover, the technology may also be used for combined metallic materials.

The heat-exchanger and the technology for making it may be automated since both the heat-exchanger construction and the apparatus for making it can be used for several purposes and several sizes.

In addition to automatisability, the technology allows a high degree of mechanised prefabrication. This in turn minimises the labour requirements. Not only does this improve manufacturing costs but also greatly reduces the risks and sources of human error. The net effect is that the quality of the manufacture is improved to such an extent that per unit time the heat-exchanger area is greater than that with the known solutions.

The process and apparatus require relatively little investment, their use and operation do not require any special measures for potecting operators and they do not have a harmful effect on the environment or on the health of the operators.

I claim:

1. A process for making a heat exchanger of aluminum, comprising:

applying a pattern of stop weld material to a first plate element;

superimposing a second element on the first plate element and hot-rolling the plate elements together to form a plate;

expanding the sides of the plate that are protected by the stop weld material by the application of fluid pressure to form a plurality of tubular heat exchanger medium flow passages;

securing a plurality of fins by direct weld, without the use of foreign materials, at only one of their ends to the plate;

holding a plurality of the plates in a frame; and securing the other end of each fin to the other part of a plate by applying additional fluid pressure with the tubular passages of sufficient magnitude to cause permanent deformation and metal-to-metal cohesive bonding between the other end and the surface of the plate.

* * * * *